US010016648B2

(12) United States Patent
Briley

(10) Patent No.: US 10,016,648 B2
(45) Date of Patent: Jul. 10, 2018

(54) LEG PRESS ATTACHMENT

(71) Applicant: Gordon Briley, Traverse City, MI (US)

(72) Inventor: Gordon Briley, Traverse City, MI (US)

( * ) Notice: Subject to any disclaimer, the term of this patent is extended or adjusted under 35 U.S.C. 154(b) by 140 days.

(21) Appl. No.: 14/990,598

(22) Filed: Jan. 7, 2016

(65) Prior Publication Data

US 2016/0199688 A1 Jul. 14, 2016

Related U.S. Application Data

(60) Provisional application No. 62/101,248, filed on Jan. 8, 2015.

(51) Int. Cl.

| | |
|---|---|
| ***A63B 23/04*** | (2006.01) |
| ***A63B 21/078*** | (2006.01) |
| ***A63B 21/06*** | (2006.01) |
| ***A63B 21/072*** | (2006.01) |
| ***A63B 21/075*** | (2006.01) |
| ***A63B 21/00*** | (2006.01) |
| ***A63B 21/062*** | (2006.01) |

(52) U.S. Cl.

CPC ..... *A63B 21/078* (2013.01); *A63B 21/0615* (2013.01); *A63B 21/0628* (2015.10); *A63B 21/075* (2013.01); *A63B 21/0724* (2013.01); *A63B 21/0783* (2015.10); *A63B 21/4031* (2015.10); *A63B 21/4034* (2015.10); *A63B 21/4035* (2015.10); *A63B 21/4047* (2015.10); *A63B 23/0429* (2013.01); *A63B 2210/00* (2013.01); *A63B 2210/50* (2013.01)

(58) Field of Classification Search

CPC ..... A63B 21/4033; A63B 21/4034; A63B 21/4035

See application file for complete search history.

(56) References Cited

U.S. PATENT DOCUMENTS 5,626,548 A * 5/1997 Coyle ..... A63B 23/0405 482/134

* cited by examiner

*Primary Examiner* — Gregory Winter
*Assistant Examiner* — Rae Fischer
(74) *Attorney, Agent, or Firm* — Clark Hill PLC; James R. Foley

(57) ABSTRACT

A leg press attachment which is configured to be engaged with a squat rack, and thereafter used to perform many different exercises. The leg press attachment is engageable with hooks on the squat rack such that the leg press attachment pivots during use relative to the squat rack yet includes at least one stop for limiting the extent of its pivoting relative to the squat rack. Preferably, the device can be removed from the hooks and engaged directly with the squat rack, during which time the at least one stop secures the device relative to the squat rack. Preferably, the leg press attachment is also configured such that it can be removed from squat rack, and converted to a sled for pushing along the floor.

13 Claims, 7 Drawing Sheets

LEG PRESS ATTACHMENT

RELATED APPLICATION (PRIORITY CLAIM)

This application claims the benefit of Provisional Application Ser. No. 62/101,248, filed Jan. 8, 2015, which is hereby incorporated herein by reference.

BACKGROUND

This application generally relates to fitness rigs and squat rack attachments.

Many pieces of traditional fitness equipment are very large and expensive. Many fitness facilities have limited floor space. Even if a given fitness facility has a lot of floor space, it still makes good business sense to populate the fitness facility with the right equipment.

For example, a leg press machine can weigh over 1,000 pounds and often demand nearly 100 square feet of floor space. These leg press machines are typically quite expensive. Therefore, they are neither space effective nor cost effective. Also, there are only so many different excises you can perform using a leg press machine.

A recent trend has increased the popularity of fitness rigs, because they do not take up all that much space, yet they can be used to perform a bunch of different exercises. For the same reason, multipurpose squat racks are also becoming more popular. However, the uses for these multipurpose squat racks are limited by the attachments that are designed to fit them.

SUMMARY

An object of an embodiment of the present invention is to provide a multipurpose weight training device which is configured to be engaged with a squat rack or the hooks of the squat rack, and used to perform many different types of exercises.

The multipurpose nature of the device, and its simple, lightweight design render it a cost effective option that can easily be removed and stored, taking up very little space. It also specifically configured to utilize other pieces of fitness equipment that are commonly found in most fitness centers, and this helps to also keep the need down for buying repetitive pieces of equipment.

In a preferred embodiment, the weight training device comprises a squat rack leg press attachment which is convertible to a sled for pushing along a floor.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF ILLUSTRATED EMBODIMENTS

Figure 1:
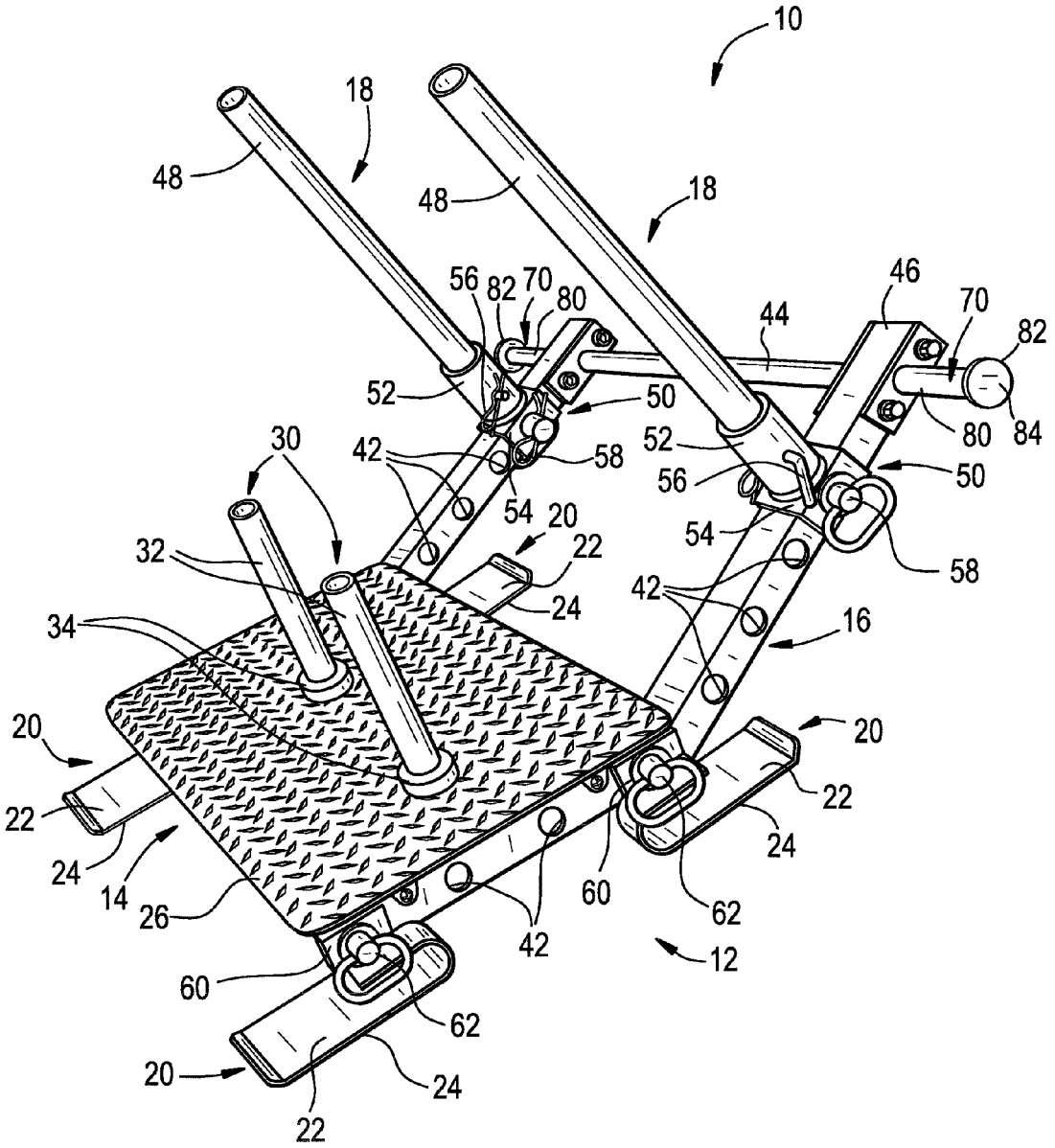
FIG. 1 is a perspective view of a weight training device which is in accordance with an embodiment of the present invention, wherein the device is configured to be used as a sled.

While the present invention may be susceptible to embodiment in different forms, there are shown in the drawings and will be described herein in detail, specific embodiments with the understanding that the present disclosure is to be considered an exemplification of the principles of the invention, and is not intended to limit the invention to that as illustrated. In each of the figures, like reference numerals are used to identify like parts.

An embodiment of the present invention provides a weight-training device that can be used to perform many different exercises. Preferably, the device is configured such that it is effectively convertible into many different modes of operation, for use for performing different exercises.

FIG. 1 shows the device 10 configured to be used as a weight-training sled 12 for pushing along a floor. As shown, the weight training sled 12 comprises a platform 14 preferably configured to retain weights thereon, a frame 16 extending from the platform 14, a plurality of arms 18 which are configured to be selectively attached to and detached from the frame 16 at a plurality of locations on the frame 16, and a plurality of detachable feet 20 each of which comprises a floor-engaging portion 22 having a flat surface 24 configured to contact the floor.

Figure 5:
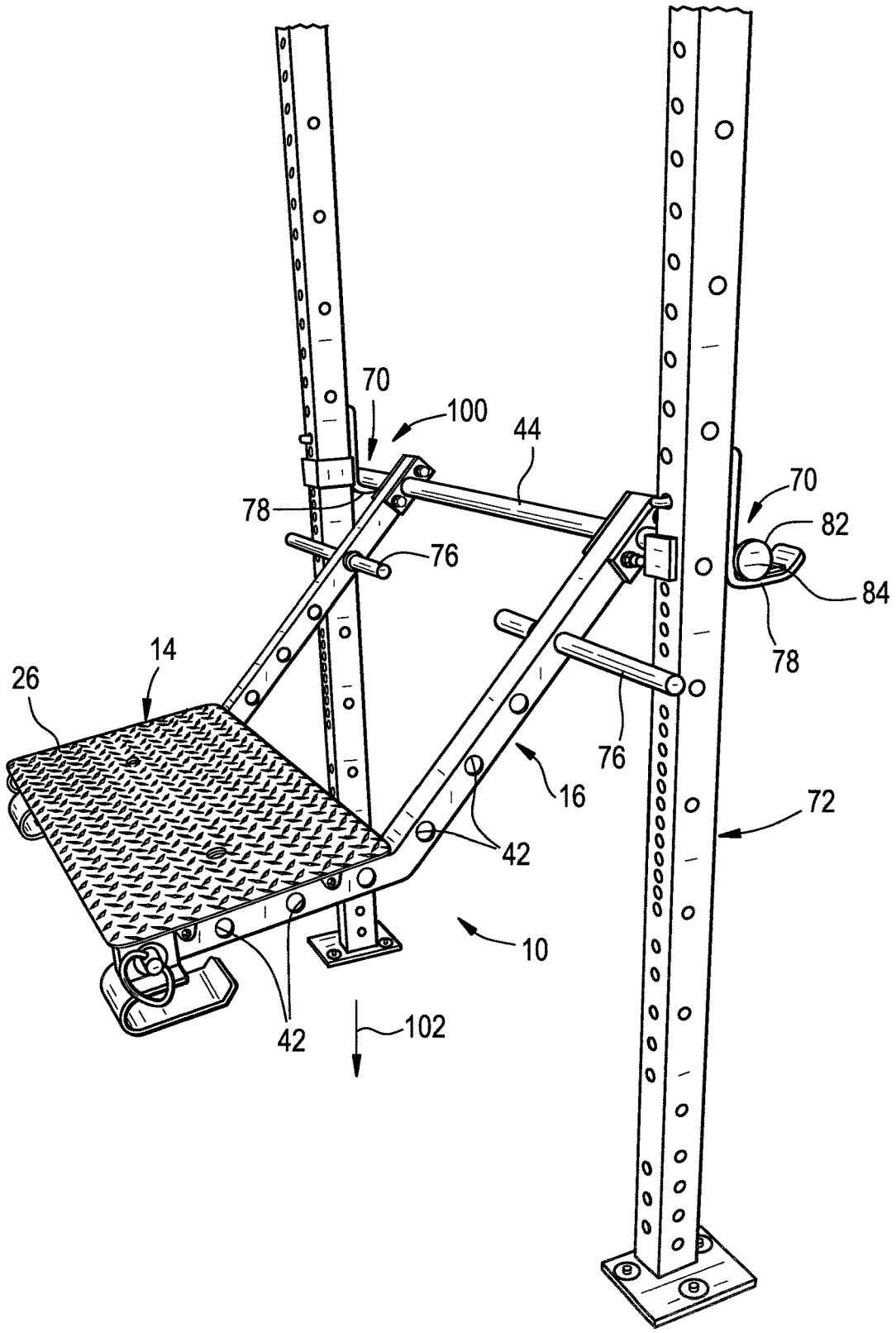
FIG. 5 shows the device configured to be used as a step.

The platform 14 may comprise a generally flat top surface 26 which is secured to the frame 16, and the platform 14 preferably includes at least one hole 28 therein (shown in FIG. 2) for receiving a weight-supporting post 30. Preferably, as shown in FIG. 1, extending up from the top surface 26 of the platform 14 is at least one post 30 which is configured to support weights retained on the platform 14. FIG. 1 shows two posts 30, wherein weights (not specifically shown) can be stacked on either one or both posts 30, on the flat surface 26 of the platform 14. Preferably, each post 30 comprises a cylindrical rod 32 having a collar 34 thereon which effectively seats the post 30 on the platform 14. As shown in FIG. 5, the back side 36 of the platform 14 preferably includes post-support structure 38 for supporting the posts 30 in their upright position, for supporting the corresponding stack of weights on the top surface 26 of the platform 14. As shown in FIG. 5, the back side 36 of the platform 14 may also include support structure 40 to provide the platform 14 with additional overall structural support viz-a-viz the frame 16. The weight-supporting posts 30 basically drop into the holes 28 (see FIG. 2) in the platform 14, to provide as shown in FIG. 1. As such, each weight supporting post 30 is selectively engageable with (see FIG. 1) and disengageable from (see FIG. 2) the platform 14.

The entire structure may be made of steel or some other type of metal. Specifically, the frame 16 may comprise square steel tubes which are welded together. As shown in FIG. 1, the frame 16 preferably includes a plurality of holes 42 or other appropriate structure for receiving the detachable feet 20, as well as for receiving the detachable arms 18. A cross bar 44 or other support structure may connect to the frame, proximate the top of the frame 16, to provide structural support to the frame 16.

Each arm 18 may comprise a cylindrical tube 48 and an attachment member 50. The attachment member 50 may comprise a tube-receiving portion 52 which is connected (such as welded) to a frame-engaging portion 54. The tube-receiving portion 52 may comprise a cylindrical collar which is shaped and configured to receive and secure the cylindrical tube 48. The frame-engaging portion 54 may comprise a bracket which is shaped and configured to engage and secure to the frame 16. Preferably, the cylindrical tube 48 is securable to the tube-receiving portion 52 of the attachment member 50 using pins 56, and the frame-engaging portion 54 is also securable to the frame using pins 58, i.e., through any of the holes 42 which are provided on the frame 16, depending on where a user wants the arms 18 connected to the frame 16.

In addition to a floor-engaging portion 22, preferably each foot 20 also has a platform-engaging portion 60, such as a bracket, which secures to the platform 14, such as via pins 62, as shown in FIG. 1.

In operation, the arms 18 are secured to the frame 16 at any desired location on the frame 16 (using the attachment members 50 and pins 56, 58), the feet 20 are attached to the platform 14 (using pins 62), weights are stacked on the posts 30, and then the device 10 can be pushed or pulled along the floor like a sled.

As shown in FIG. 1, preferably hook engagement members 70 connect to (such as by being bolted) and extend out from the frame 16, and these members 70 are configured to engage a squat rack once the device is effectively converted to perform, for example, leg presses. This will now be described.

Figure 2:
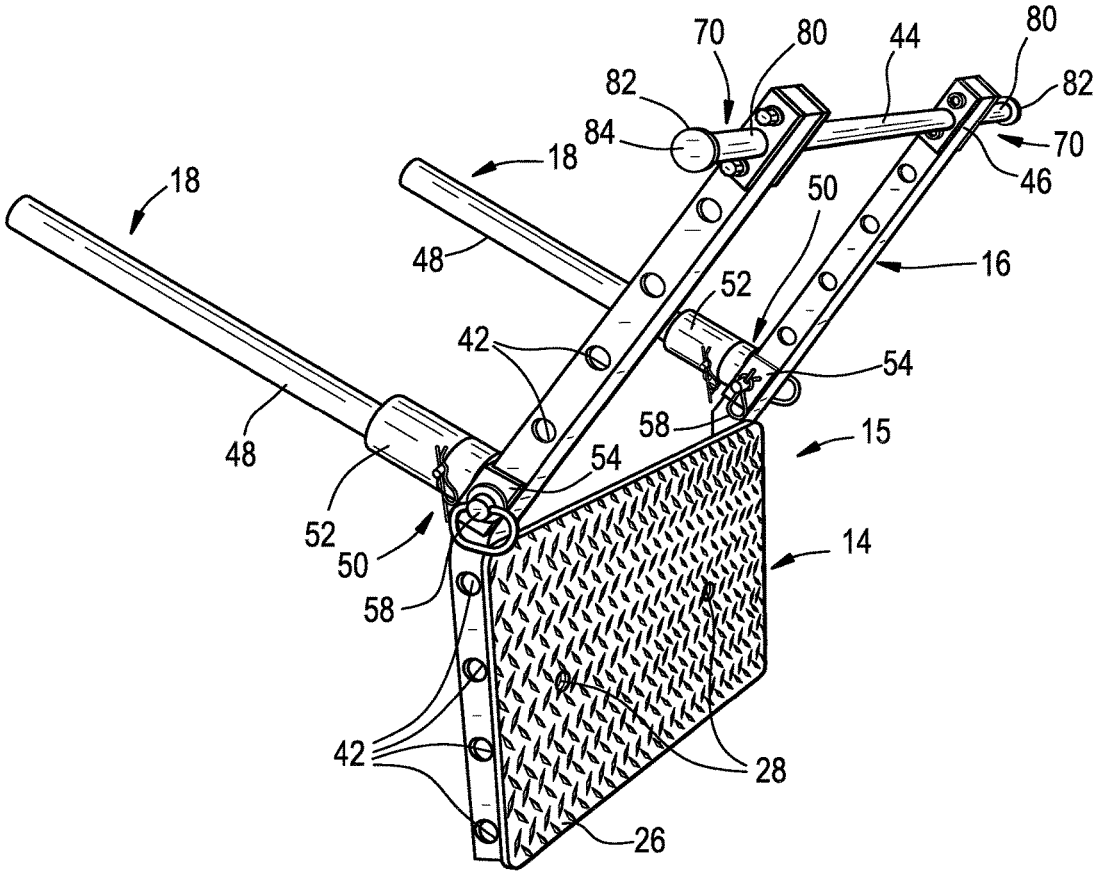
FIG. 2 is a perspective view of the device shown in FIG. 1, showing the device after it has been converted to be used as a leg press.
Figure 3:
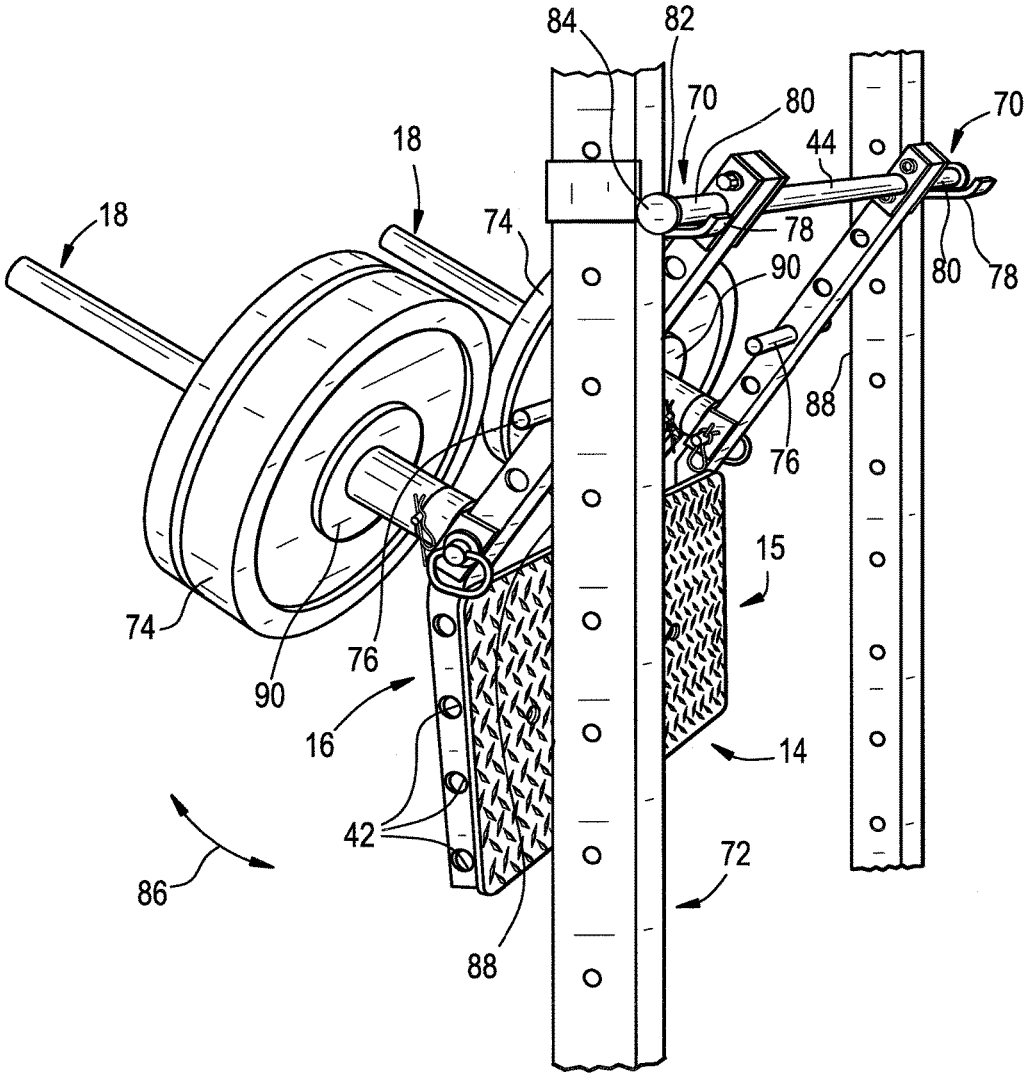
FIG. 3 is similar to FIG. 2, but shows the device engaged with a squat rack.

As shown in FIG. 2, the posts 30 which extend up from the platform 14 can be removed, and the feet 20 detached from the platform 14. The arms 18 can also be detached from the frame 16, and then re-attached to the frame 16 such that they extend from the frame 16 in the opposite direction from which they used to extend (i.e., when the device is used as a sled). Thereafter, the device 10 can be hung on a squat rack 72 as shown in FIG. 3, and weights 74 loaded on the arms 18 (as such the arms 18 effectively become weight-carrying members). As shown, stops 76 in the form of posts may also be engaged with the frame 16 in whatever holes 42 are selected by the user. The stops 76 are selectively engageable with and disengageable from the frame 16 at a plurality of locations on the frame 16 (in the holes 42), and are configured to contact the frame 16 and limit further pivoting of the device 10 in one direction relative to the squat rack 72.

Specifically, the hook engagement members 70 that extend from the frame 16 of the device are preferably configured to lay on hooks (i.e., J-hooks) 78 on the squat rack 72. Preferably, each of the hook engagement members 70 comprises a cylindrical portion 80 (which can also be flat, or at least provide a flat surface) which lays on the surface of the squat rack hook 78, and a stop portion 82 at the end 84 which tends to prevent the hook engagement member 70 from sliding off the squat rack hook 78. This allows the device 10 to hang on the squat rack 72, and effectively swing or pivot relative to the squat rack 72 (as indicated by arrow 86 in FIG. 3), during which time the stops 76 on the frame 16 prevent the device 10 from pivoting too far (i.e., too far to the right in FIG. 3). Specifically, preferably the stops 76 are configured to contact surfaces 88 of the squat rack 72 to prevent further pivoting of the device 10. Although not specifically shown, bands can also be attached to these stops 76 in order to increase the resistance, wherein one end of the band attaches to the stop 76 and the other end attaches to an attachment (not specifically shown) connected to the squat rack 72.

In operation, a user pulls a bench (not specifically shown) up to the squat rack 72, sits on the bench, places his or feet on the leg press surface (i.e., on the top surface 26 of the platform 14), and pushes the platform 14 with his or legs, causing the device 10 to pivot relative to the squat rack 72 (as indicated by arrow 86 in FIG. 3). The user can perform repetitions of leg presses, during which time the stops 76 prevent the device 10 from pivoting too far toward the user (i.e., too far toward the right in FIG. 3). As shown in FIG. 3, disks 90 may be engaged with the arms 18 for engaging the weights 74 and preventing the weights 74 from descending too far down along the arms 18 toward the platform 14.

Figure 4:
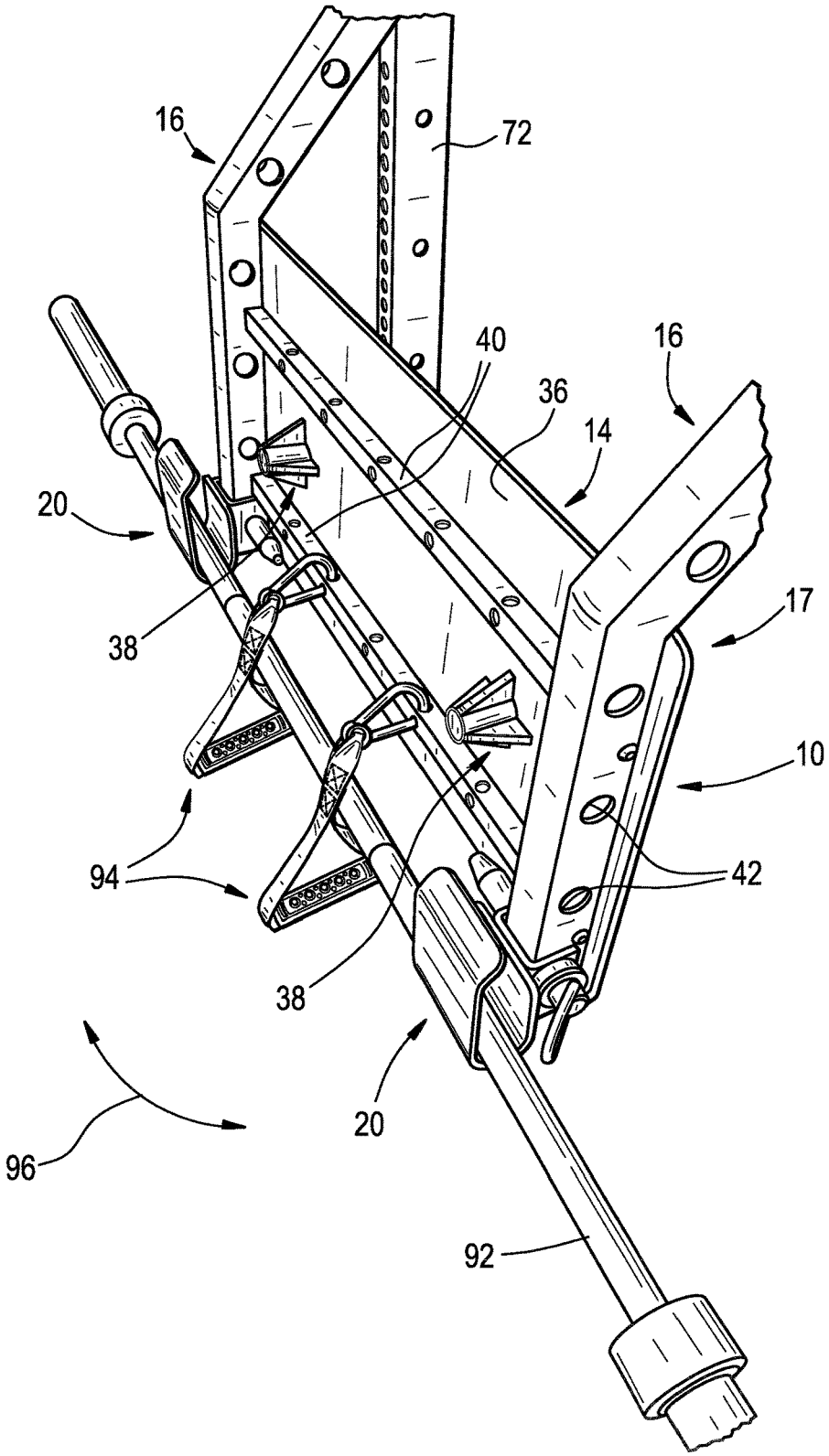
FIG. 4 shows the device configured to be used as a back row.

The device 10 can also be used to perform back rows, as shown in FIG. 4. In that case, the device 10 hangs from the hooks 78 of a squat rack 72 as shown in FIG. 3, but the arms 18 are detached. Two of the feet 20, or some other appropriate structure, can be engaged with the platform 14 for holding a barbell 92, and handle straps 94 can be engaged with the underside 36 of the platform 14. In this embodiment, the feet 20 can be regarded as being hook members for holding the barbell of other appropriate attachments to the device 10 can be provided for achieving this same purpose.

In use, weights are loaded on the ends of the bar 92, and the handle straps 94 are pulled by the user to perform the exercise, causing the device 10 to pivot relative to the squat rack 72 (as indicated by arrow 96 in FIG. 4). The stops 76 can still be employed as shown in FIG. 3, to prevent over pivoting of the device 10 relative to the squat rack 72, in this case to prevent pivoting of the device too far away from the user during the performance of back row repetitions (i.e., too far to the right in FIG. 4). Although not specifically shown, bands can also be attached to these stops 76 (or to the bar 92) in order to increase the resistance, wherein one end of the band attaches to the stop 76 or the bar 92 and the other end attaches to an attachment (not specifically shown) connected to the squat rack 72.

FIG. 5 shows the device 10 being used as a step 100. During such use, the device 10 hangs from the squat rack 72 (i.e., from the hooks 78), and the stops 76 are used to contact the squat rack 72 and prevent the device 10 from pivoting any further downward toward to the floor (i.e., in the direction of arrow 102 in FIG. 5). As such, the top surface 26 of the platform 14 can be used as a step without the device 10 pivoting during use.

While the device 10 was described as being effectively convertible from one type of device to another (i.e., from a sled 12 (see FIG. 1) to a leg press 15 (see FIGS. 2 and 3) to a back row 17 (see FIG. 4) to a step 100 (see FIG. 5)), the device 10 can also be provided as being a single purpose type of device.

For example, the device 10 can be provided as being solely a sled 12 as shown in FIG. 1, with permanent feet that do not detach from the platform 14. The arms can also be provided as being permanently attached to the frame 16 (or can still be provided as being adjustable).

The device 10 can be provided as being solely a leg press attachment 15 as shown in FIGS. 2 and 3, lacking any weight-supporting posts 30 or feet 20 such as is shown in FIG. 1. Alternatively, the device 10 can be provided as being solely a back row attachment 17 as shown in FIG. 4, or solely a step 100 as shown in FIG. 5. Still other uses are entirely possible while still staying within the scope of the present invention.

All that being said, it is preferred that the device be provided as being multipurpose as was described in detail hereinabove.

Figure 6:
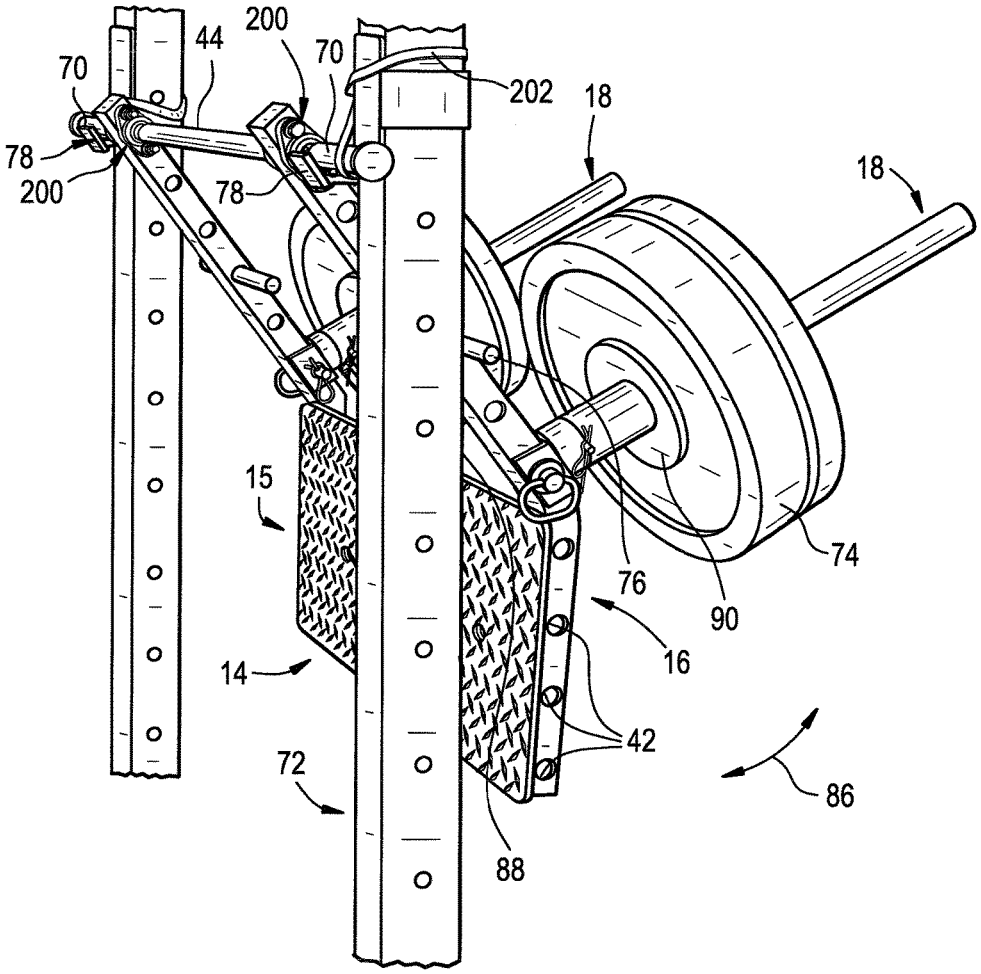
FIGS. 6 and 6A illustrate an alternative embodiment, wherein instead of being bolted to the frame, hook engagement members are connected to the frame using a bearing arrangement.
Figure 6A:
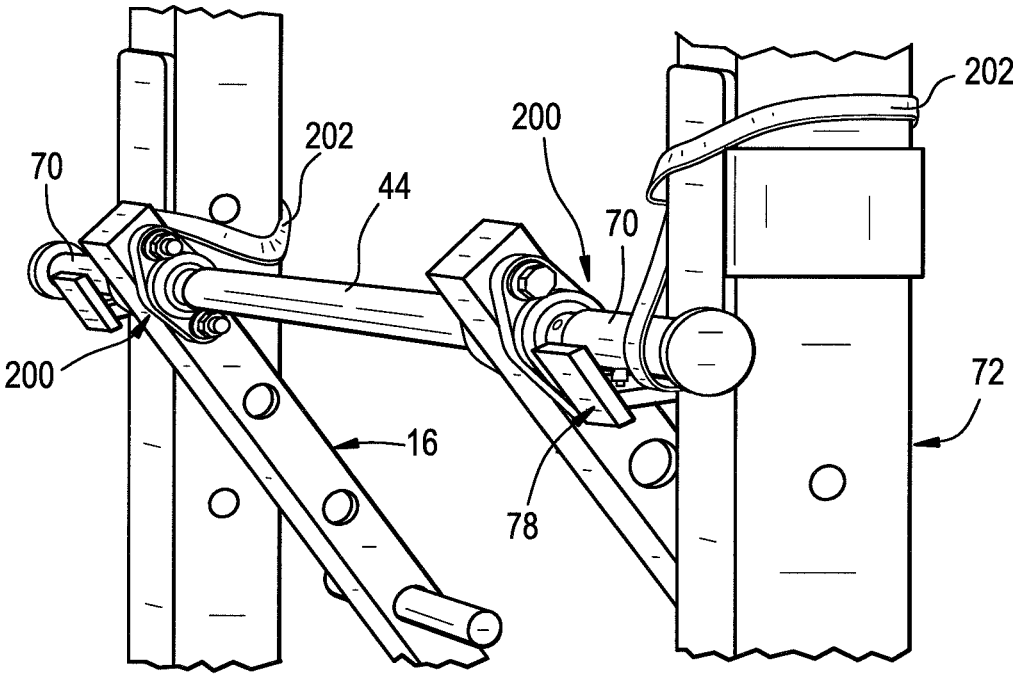

FIGS. 6 and 6A illustrate an alternative embodiment, wherein instead of being bolted to the frame 16, the hook engagement members 70 are connected to the frame 16 using a bearing arrangement 200, which provides that the hook engagement members 70 need not pivot as the remainder of the device does pivot while the device is being used. As shown, ties or straps 202 can be used to further support the device relative to the squat rack 72.

While specific embodiments of the invention have been shown and described, it is envisioned that those skilled in the art may devise various modifications without departing from the spirit and scope of the present invention.

What is claimed is:

1. A leg press attachment, comprising:

a platform having a generally flat surface;

a frame configured to support the platform and having two extensions extending away from the platform at an obtuse angle relative to the platform; and a hook-engagement post attached to each extension and configured to rest on hooks disposed on a rack, wherein the hook-engagement post is configured to pivot relative to the hooks allowing the leg press attachment to move in response to force applied to the platform surface by the user.

2. A leg press attachment as recited in claim 1, further comprising:

a hole in the surface of the platform; and a weight-supporting post configured to retain weights and removably attached to the platform via the hole.

3. A leg press attachment as recited in claim 1, further comprising an arm removably and adjustably attached to the frame and configured to retain exercise weights.

4. A leg press attachment as recited in claim 3, wherein the arm is selectively engageable with and disengageable from the frame at a plurality of locations on the frame.

5. A leg press attachment as recited in claim 3, further comprising:

a second arm removably and adjustably attached to the frame; and a plurality of feet, each of configured to slide across the floor while supporting the platform and frame, wherein the arms are configured for pushing the leg press attachment along the floor.

6. A leg press attachment as recited in claim 1, further comprising a stop post, wherein the stop post is selectively engageable with and disengageable from the frame and is configured to contact the rack to limit the range of pivoting of the leg press attachment relative to the rack.

7. A leg press attachment as recited in claim 1, further comprising a stop portion, wherein the stop portion is configured to prevent the hook-engagement post from losing contact with the hook of the rack.

8. A leg press attachment as recited in claim 1, further comprising a plurality of feet, each configured to slide across the floor while supporting the platform and frame.

9. A leg press attachment as recited in claim 8, wherein each foot is detachable.

10. A leg press attachment as recited in claim 8, wherein each foot forms a hook engageable with the frame and configured to retain a weight bar.

11. A leg press attachment as recited in claim 1, further comprising two arms, each removably and adjustably attached to the frame and configured to retain exercise weights.

12. A leg press attachment as recited in claim 11, wherein each arm is selectively engageable with and disengageable from the frame at a plurality of locations on the frame.

13. A leg press attachment, comprising:

a platform having a generally flat surface;

a frame configured to support the platform and having two extensions extending away from the platform at an obtuse angle relative to the platform; and a hook-engagement post attached to each extension via a bearing and configured to rest on hooks disposed on a rack, wherein each bearing is configured to allow the frame to pivot relative to the hook-engagement post and hook such that the leg press attachment moves in response to force applied to the platform surface by the user.

* * * * *